US012109449B1

(12) United States Patent
Gao

(10) Patent No.: US 12,109,449 B1
(45) Date of Patent: Oct. 8, 2024

(54) HULA HOOP

(71) Applicant: Kehua Gao, Shenzhen (CN)

(72) Inventor: Kehua Gao, Shenzhen (CN)

( * ) Notice: Subject to any disclaimer, the term of this patent is extended or adjusted under 35 U.S.C. 154(b) by 0 days.

(21) Appl. No.: 18/417,619

(22) Filed: Jan. 19, 2024

(30) Foreign Application Priority Data

Sep. 7, 2023 (CN) ..... 202311155636.9

(51) Int. Cl.

| | |
|---|---|
| ***A63B 19/00*** | (2006.01) |
| ***A63B 21/06*** | (2006.01) |
| ***A63B 21/065*** | (2006.01) |
| ***A63B 71/06*** | (2006.01) |
| ***A63H 33/02*** | (2006.01) |

(52) U.S. Cl.
CPC ..... *A63B 21/0608* (2013.01); *A63B 19/00* (2013.01); *A63B 21/065* (2013.01); *A63B 71/0669* (2013.01); *A63H 33/02* (2013.01); *A63B 2213/007* (2013.01)

(58) Field of Classification Search
CPC . A63B 21/0608; A63B 21/0605; A63B 19/00; A63H 33/02
See application file for complete search history.

(56) References Cited

U.S. PATENT DOCUMENTS 5,338,244 A * 8/1994 Huang ..... A63B 19/00 446/236
6,231,420 B1 * 5/2001 Lin ..... A63B 19/00 446/241
11,173,336 B1 * 11/2021 Xu ..... A63B 21/0608
11,446,533 B1 * 9/2022 Xu ..... A63B 21/222
2014/0342882 A1 * 11/2014 Huang ..... A63B 21/222 482/110
2017/0100620 A1 * 4/2017 Hsiao ..... A63B 21/0618
2021/0252323 A1 * 8/2021 Lu ..... A63B 21/0608
2023/0130904 A1 * 4/2023 Lu ..... A63H 33/02 446/236

FOREIGN PATENT DOCUMENTS

CN 217645747 U * 10/2022

OTHER PUBLICATIONS

Translation CN217645747U (Year: 2022).*

* cited by examiner

*Primary Examiner* — Eugene L Kim
*Assistant Examiner* — Alyssa M Hylinski
(74) *Attorney, Agent, or Firm* — Rhodes IP PLC; Christopher R Rhodes

(57) ABSTRACT

The present disclosure relates to a hula hoop. The hula hoop includes a track assembly with a plurality of track units interconnected end-to-end and a slider provided with rollers. The track unit includes an outer track having a receiving channel located at a first end and a protruding portion located at a second end opposite to the first end, a pressing component configured to secure two adjacent track units, and an inner track for jointly defining a circular path with the outer track. The rollers of the slider are configured to slide along the circular path. The hula hoop of the present disclosure is easy to assemble and disassemble.

17 Claims, 7 Drawing Sheets

HULA HOOP

CROSS-REFERENCE TO RELATED APPLICATIONS

This application claims priority under 35 U.S.C. § 119(a) to Chinese Patent Application No. 2023111556369, filed on Sep. 7, 2023, which is hereby incorporated by reference herein in its entirety.

TECHNICAL FIELD

The present disclosure relates to a fitness equipment, particularly a hula hoop, and more particularly, a luminous hula hoop.

BACKGROUND ART

Hula hoop is a fitness equipment designed for exercising a waist area. Existing hula hoop is not limited to a singular, integral ring structure, and can also be assembled from multiple assembly parts. In this assembled configuration of the hula hoop, a loop worn around the user's waist defines a circular track, and a slider with an added weight moves along this circular track on the hoop.

Document CN216092050U discloses a luminous hula hoop including a hula hoop body consisting of a plurality of parts interconnected to form a loop structure, each provided with a light source and a light diffuser to make the hula hoop body emit light when necessary. This device requires the arrangement of luminous units in each of the parts.

Document CN217311770U discloses a silent smart hula hoop, comprising a hula hoop body, a counting device slidably connected to the hula hoop body, and an added weight fixedly connected to the counting device, wherein the hula hoop body includes a housing with tracks arranged at upper and lower ends on its inner side, and wherein rollers that can roll around the tracks are arranged on the counting device.

Currently, commercially available detachable hula hoop is composed of a plurality of units connected end-to-end, with a detachable connecting element positioned between adjacent units. Each unit is provided with a slot for the insertion of the connecting element, and both ends of the connecting elements are respectively inserted into the slots of two adjacent units. Moreover, the unit is provided with a locking mechanism to secure the connecting element within the slot. However, hula hoops of such configuration are prone to generating significant noise during use due to the looseness between units. Traditional noise reduction methods rely on reducing the number of units or designing more complex structures to achieve noise reduction.

SUMMARY

A hula hoop is provided to address the aforementioned technical problems.

According to embodiments in the present disclosure, the hula hoop comprises:

a track assembly with a plurality of track units interconnected end-to-end, each track unit including:

a. an outer track having a receiving channel located at a first end and a protruding portion located at a second end opposite to the first end, b. a pressing component configured to secure two adjacent track units, and c. an inner track, which defines a circular path together with the outer track; and a slider provided with one or more rollers, which are configured to slide along the circular path.

In some embodiments, the slider includes a first half part and a second half part defined by a dividing plane, each half part having a base portion and an extending portion, wherein the base portion is provided with one or more roller bars, and wherein the rollers are mounted on the roller bars and are rotatable.

In some embodiments, each extending portion has a first opening, and the first openings of two extending portions jointly define a cavity for accommodating a light emitting device. The cavity of the slider is provided with the light emitting device, which enhances its entertainment value.

In some embodiments, the slider is provided with a controller and a sensor for detecting the movement of the slider, wherein the controller is configured to control the light emitting device based on the detection by the sensor.

In some embodiments, when the slider's rotation speed is within a first speed range, the controller controls the light emitting device to emit lights of a first color, and when the slider's rotation speed is within a second speed range, the controller controls the light emitting device to emit lights of a second color different from the first color.

In some embodiments, when the slider's rotation speed is within a first speed range, the controller controls the light emitting device to flash at a first frequency, and when the slider's rotation speed is within a second speed range, the controller controls the light emitting device to flash at a second frequency different from the first frequency.

In some embodiments, the rotation speed of the slider within the first speed range is lower than in the second speed range, and the second frequency is greater than the first frequency.

In some embodiments, the controller controls the light emitting device to continuously illuminate.

In some embodiments, when the slider's rotation speed is within a first speed range, the controller controls the light emitting device to illuminate at a first brightness, and when the slider's rotation speed is within a second speed range, the controller controls the light emitting device to illuminate at a second brightness different from the first brightness.

In some embodiments, the rotation speed of the slider within the first speed range is lower than in the second speed range, and the second brightness is greater than the first brightness.

In some embodiments, the hula hoop comprises an added weight, which is attached to the slider through a tether. The added weight includes a shell, and the shell is filled with at least one of water, sand, and metal particles (such as iron, copper, or alloy).

In some embodiments, the inner track is provided with a recess at the first end, and an engaging portion of the outer track is inserted into the recess, such that a secure connection between the inner track and the outer track along a direction substantially perpendicular to a positioning column can be achieved.

In some embodiments, the pressing component is switchable between a first position and a second position, wherein in the first position, an elastic element of the pressing component undergoes deformation to position away from a pressing body of the pressing component, and wherein in the second position, the elastic element of the pressing component is not under force and remains substantially stationary relative to the outer track and the inner track.

In some embodiments, the inner track has a limiting column for restricting the movement of the pressing body operated by a user.

In some embodiments, the pressing component has a positioning body that defines a positioning channel, wherein the positioning column of the outer track extends through the positioning channel and is inserted into a positioning hole.

In some embodiments, the material for the roller is selected from at least one of nylon, polyoxymethylene (POM), acrylonitrile butadiene styrene (ABS), and polyurethane (PU), which is advantageous for reducing noise.

In some embodiments, the track unit comprises an outer track, an inner track connected to the outer track to jointly define a circular path, and a support fixed to the inner track.

In some embodiments, the support is positioned close to an end of the inner track.

The present disclosure provides a hula hoop that is easy to assemble and disassemble.

The present disclosure also provides a hula hoop with a light emitting device (such as LEDs).

The present disclosure also provides a hula hoop with an added weight filled with water, the amount of which is easy to adjust and convenient to replenish.

The present disclosure also provides a hula hoop comprising:

a track assembly with a plurality of track units interconnected end-to-end, each track unit including:

a. an outer track having a receiving channel located at a first end and a protruding portion located at a second end opposite to the first end, b. a pressing component configured to secure two adjacent track units, and c. an inner track for jointly defining a circular path with the outer track; and a slider provided with one or more rollers, which are configured to slide along the circular path, wherein the protruding portion of the outer track includes at least two side protruding fingers, and an intermediate protruding finger located between two side protruding fingers, and the side protruding fingers are configured to be inserted into side channels of the receiving channel, such that after assembly, a distance between an end face of the side protruding finger of the outer track and an end face for delimiting a side channel of an adjacent outer track is in the range of 0.5 mm to 10 mm.

The small gap between the outer tracks of the track units in the hula hoop in the present disclosure ensures that when the rollers of the slider slide along the circular path defined by both the inner and outer tracks, they do not pass through a long section with notches (which could hinder the slider's movement and result in significant noise). This design significantly reduces the generation of noise, especially when combined with the use of rollers made from the aforementioned materials, it can even achieve a silent operation.

BRIEF DESCRIPTION OF THE DRAWINGS

In the drawings, identical or similar numbers represent identical or similar elements.

DETAILED DESCRIPTION

Figure 1:
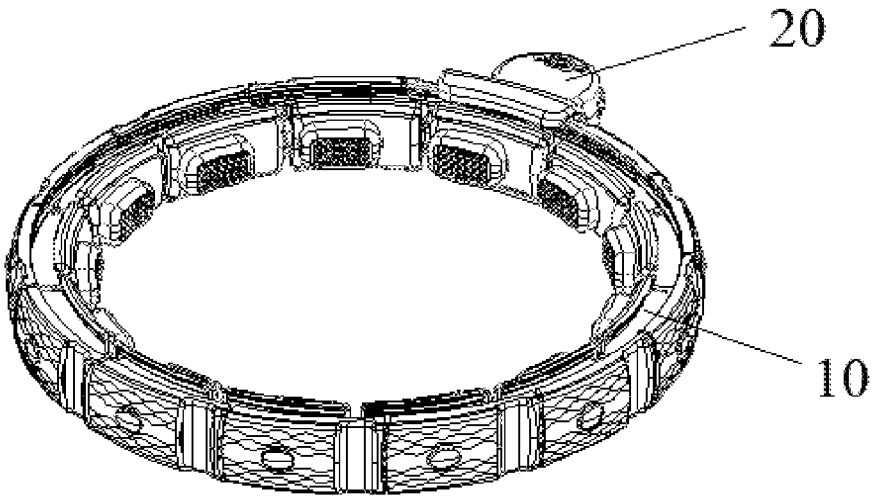
FIG. 1 illustrates a hula hoop according to an embodiment in the present disclosure.

FIG. 1 illustrates a hula hoop according to an embodiment in the present disclosure. The hula hoop includes a track assembly 10 and a slider 20 that is slidable on the track assembly 10. The track assembly 10 can be worn around the user's waist, and the slider 20, connected to an added weight, can slide circumferentially as the user twists his/her waist.

Figure 2:
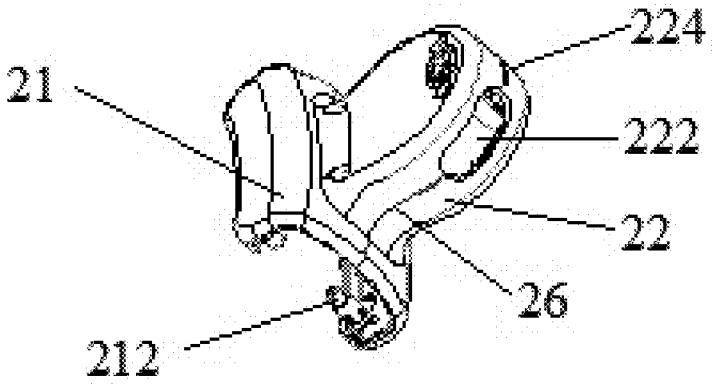
FIG. 2 illustrates a perspective view of a slider according to an embodiment in detail.

FIG. 2 illustrates a perspective view of the slider 20 according to an embodiment in detail. The slider 20 may include two half parts defined by a dividing line or dividing plane 26, each half part having a base portion 21 and an extending portion 22 extending from the base portion 21. After assembly, the two half parts collectively define an inner cavity where various electronic components, such as sensors and controllers, can be arranged. This will be described in detail below.

Each base portion 21 has a substantially L-shaped cross-section, and the base portion 21 is provided with one or more roller bars 212, a roller (not shown) is mounted on each roller bar 212 and configured to rotate around the roller bar 212. The material of the roller can be selected from any one of: nylon, polyoxymethylene, ABS, polyurethane, or a combination thereof. Preferably, the roller can be made of wear-resistant TPU GU80. The use of the mentioned materials for the roller facilitates the generation of minimal noise.

In some embodiments, each extending portion 22 has a first opening 222, and the first openings 222 of two extending portions 22 can be matched to define a cavity in the assembled slider 20, which is used for accommodating, for example, light emitting elements such as LEDs. In some embodiments, preferably, two cavities are provided at curved side surface of the slider 20. Light emitting elements can be installed in the cavities of the slider 20, which can be enclosed, for example, by a plastic casing, such as a transparent plastic casing.

FIG. 2 also illustrates a tether opening 224 of the slider 20, which is used to introduce a tether to be connected that can be attached to the added weight. In some embodiments, the tether opening 224 is defined only by one of the two half parts (i.e., formed only in a single half part). In some embodiments, the tether opening 224 is defined by two half parts together.

Figure 3:
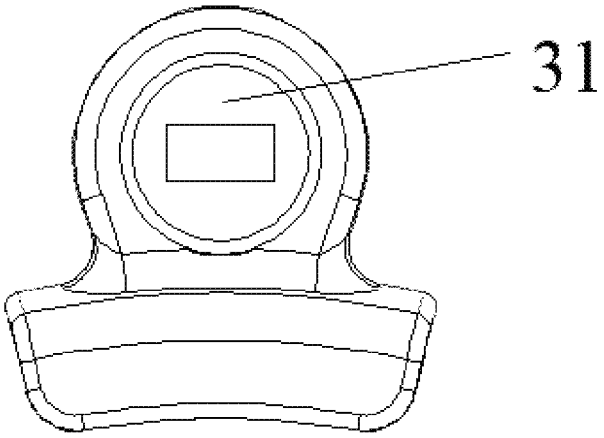
FIG. 3 illustrates a front view of the slider.
Figure 4:
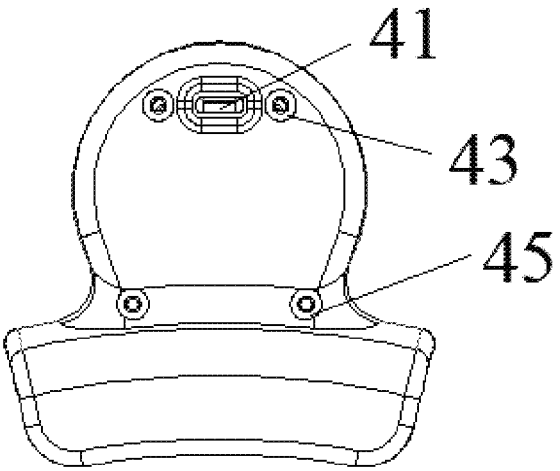
FIG. 4 illustrates a rear view of the slider.

FIGS. 3 and 4 respectively illustrate front view and rear view of the slider 20. The front side of the slider 20 may be provided with a display panel or control panel 31, which can integrate at least one button selected from, for example, a count button, a pause button and a reset button. The display panel or control panel 31 can also display exercise time and rotation counts. The opposite side, such as the back side, of the slider 20 can be provided with a charging port 41, for example, a USB port. The slider 20 further includes a plurality of holes 43, 45 for mounting bolts.

In some embodiments, sensors, such as a speed sensor, especially an angular velocity sensor, can be arranged in the slider 20 to detect the sliding speed of the slider on the track assembly. A controller can also be arranged in the slider 20, which can load a program executed to control, for example, LED illumination based on the values detected by the sensors. For instance, the LEDs can be controlled to emit different colors of light in a flashing or steady manner based on the sliding speed within different ranges. In some embodiments, for instance, a sensor sends the detected speed signals to the controller (such as a PLC), and the controller can control the LEDs to emit corresponding light based on the rotation speed of the slider 20. For instance, when a rotation speed of a slider (or a hula loop) is within a lower speed range (e.g., 0-0.8 r/s), the controller sends a signal to keep the LEDs off; when the rotation speed is within a predefined first speed range (e.g., 0.8-1.2 r/s), the controller sends a signal to cause the LEDs to emit, for example, red light; when the rotation speed is within a predefined second speed range (e.g., 1.2-1.5 r/s), the controller sends a signal to cause the LEDs to emit, for example, blue light. In a further embodiment, the LEDs can flash at different frequencies or remain steadily illuminated. For example, as the rotation speed of the slider increases from 1.0 r/s to 1.4 r/s, the flashing frequency of the LEDs will increase. In some embodiments, the LEDs can illuminate at different brightness levels. Those skilled in the art should be appreciated that various colors of light (such as red, blue, purple, yellow) and different flashing frequencies can be adaptively selected.

Figure 5:
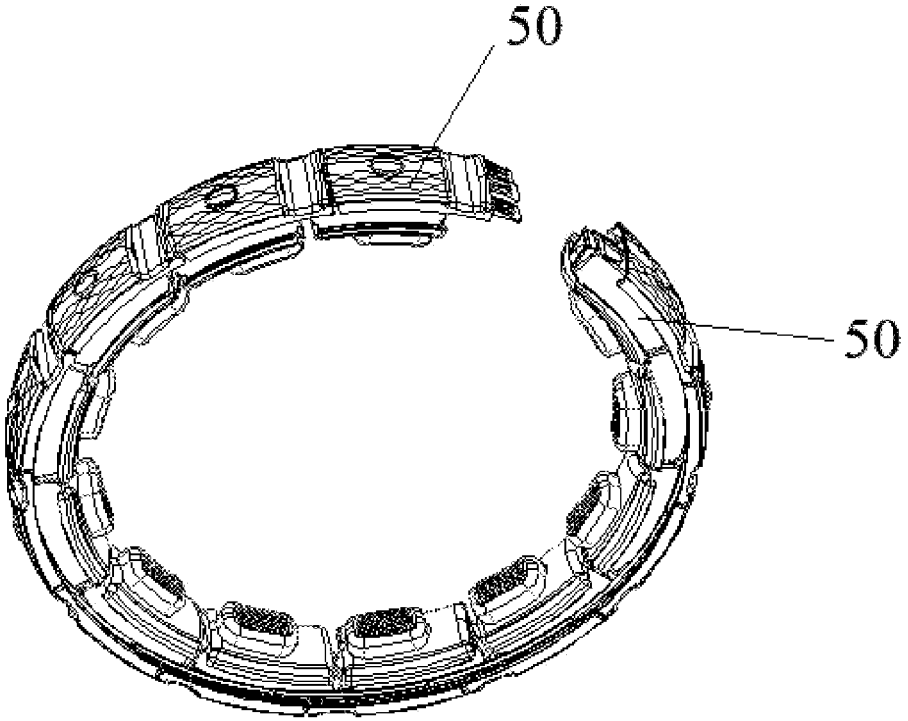
FIG. 5 illustrates a track assembly including a plurality of track units according to an embodiment.

FIG. 5 illustrates a track assembly having a plurality of track units 50 according to an embodiment, wherein adjacent track units 50 are interconnected end-to-end, preferably through a snap-fit connection.

Figure 6:
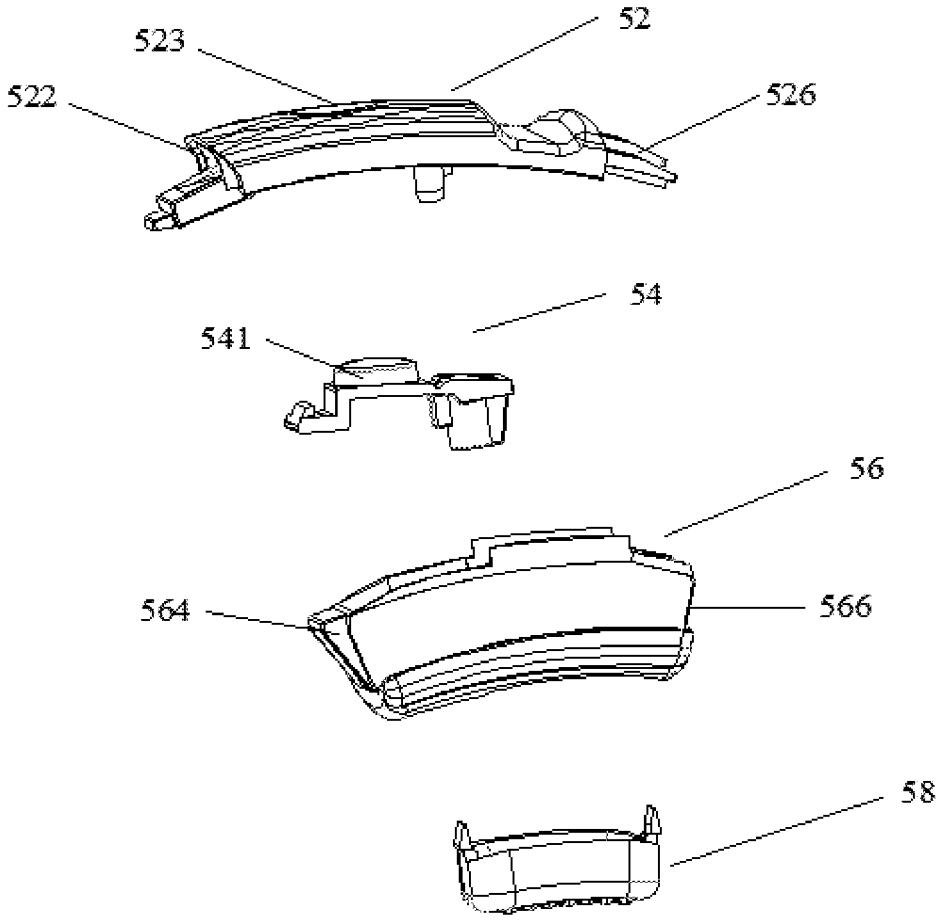
FIG. 6 illustrates an exploded view of the track unit according to an embodiment.
Figure 7:
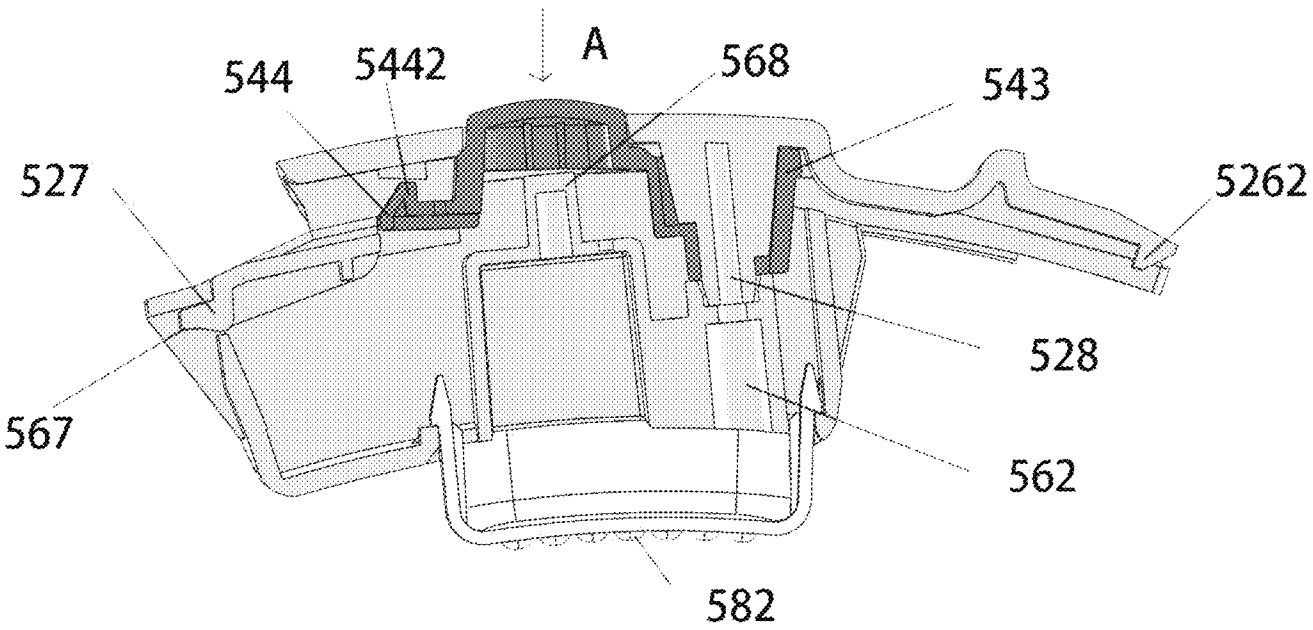
FIG. 7 illustrates a sectional view of the assembled track unit according to an embodiment.

FIG. 6 illustrates an exploded view of a track unit according to an embodiment, and FIG. 7 illustrates a sectional view of the assembled track unit according to an embodiment. As shown in FIGS. 6-7, each track unit (e.g., the track unit 50 shown in FIG. 5) includes an outer track 52, an inner track 56, and a pressing component 54.

Figure 8:
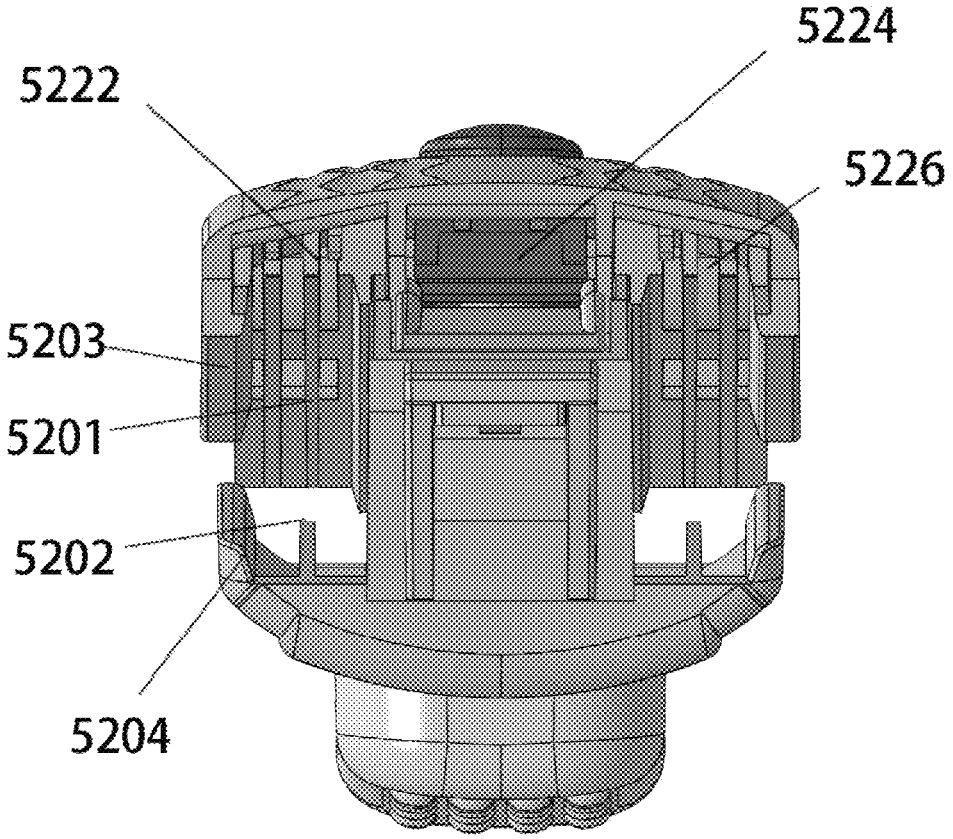
FIG. 8 illustrates a receiving channel.

The outer track 52 includes a receiving channel 522 located at a first end and a protruding portion 526 located at a second end opposite to the first end. The protruding portion 526 of the outer track 52 can be inserted into the receiving channel 522 of an adjacent outer track 52. Through this design, the connection between adjacent track units 50 is less prone to loosening, thus avoiding the noise caused by loosely connected track units. FIG. 8 provides a clearer illustration of the receiving channel 522, wherein the receiving channel 522 includes side channels 5222, 5226 that at least partially define tracks (i.e., the tracks on which the rollers of the slider travel), and an intermediate channel 5224 located between the side channels 5222, 5226. Correspondingly, the protruding portion 526 of the outer track 52 includes three protruding fingers for inserting into the channels 5222, 5226, and 5224. The interconnected adjacent outer tracks are locked through a pressing component 54, which will be described below.

The inner track 56 has a positioning hole 562, and a positioning column 528 of the outer track 52 can be inserted into the positioning hole 562 to achieve fixation between the inner track 56 and the outer track 52 (as best shown in FIG. 7). The inner track 56 further includes a male part 564 located at a first end and a female part 566 located at a second end opposite to the first end, wherein the male part 564 of the inner track 56 can engage with a female part 566 of an adjacent inner track. For instance, the male part 564 and the female part 566 have complementary contours.

The inner track 56 can be also provided with a recess 567 at the first end, and an engaging portion 527 of the outer track 52 can be inserted into the recess 567, such that a secure connection between the inner track 56 and the outer track 52 along a substantially vertical direction (i.e., substantially perpendicular to the direction of the positioning columns 528) can be achieved.

Referring to FIGS. 5-8, it can be seen that the connection point between two adjacent track units is located at the ends of the track units, and the connection point between the inner track and the outer track of the track unit is located between both ends of the track unit.

The pressing component 54 has a pressing body 541, which can be embedded into a hole on an outer surface of the outer track 52 and extends beyond the outer surface of the outer track 52 after assembly. This allows a user to easily press the pressing body 541 of the pressing component 54 along a pressing direction A. The pressing component 54 also has a positioning body 543 that defines a positioning channel. The positioning column 528 of the outer track 52 can extend through the positioning channel and be inserted into the positioning hole 562. The pressing component 54 is clamped and fixed by the outer track 52 and inner track 56 during use, in particular, the positioning body 543 of the pressing component 54 remains substantially stationary relative to the outer track 52 and/or inner track 56 during use. The pressing component 54 also includes an elastic element 544. When an intermediate protruding piece of a protruding portion 526 of an outer track 52 of an adjacent track unit is inserted into the intermediate channel 5224 of the receiving channel of the track unit 50, the elastic element 544 is deformed away from the pressing body 541 until a hook element 5262 of the intermediate protruding piece passes over a hook element 5442 of the elastic element 544. Afterward, the elastic element 544 returns to restrict the hook element 5262 of the intermediate protruding piece. In this way, two adjacent track units are securely engaged together. When a user presses down the pressing body 541 of the pressing component 54 along the pressing direction A, the elastic element 544 is deformed away from the pressing body 541. In this deformed state of the elastic element 544, the user can detach one of two adjacent track units from another.

In some embodiments, the inner track 56 has a limiting column 568 to restrict the movement of the pressing body 541 during user operation, preventing, for example, the integral pressing component 54 from breaking.

In some embodiments, the track unit may also include a support 58. The support 58 may be in a form of tank, with its upper end fitting into the inner track 56. A bottom surface of the support 58 can be provided with multiple spherical or hemispherical elements 582. The support 58 can be in direct contact with the user's waist. Therefore, the support 58 with the above designs can be served as a massage member. The support 58 is preferably positioned close to an end of the track unit, in particular the inner track, which is advantageous to prevent two supports of the adjacent track units from pinching the user's skin and causing injury. In some embodiments, the position and dimensions of the support 58 can be designed according to the requirements.

FIG. 8 illustrates a track configuration for the rollers of the slider in detail. The outer track has an outer surface 5201 for contact with the rollers, and the inner track has an outer surface 5202 for contact with the rollers. The dimension of the gap between the outer surface 5201 and the outer surface 5202 allows the rollers to roll smoothly between them. The outer track and the inner track further have limiting features 5203 and 5204 to prevent the rollers from leaving the track.

In some embodiments, the added weight may have a closed shell, such as a flexible plastic shell, with an opening to allow filling with water, sand, or similar material. A cover of the added weight can close the opening and seal the shell. The shell of the added weight has features that allow the connection of the tether.

Figure 9:
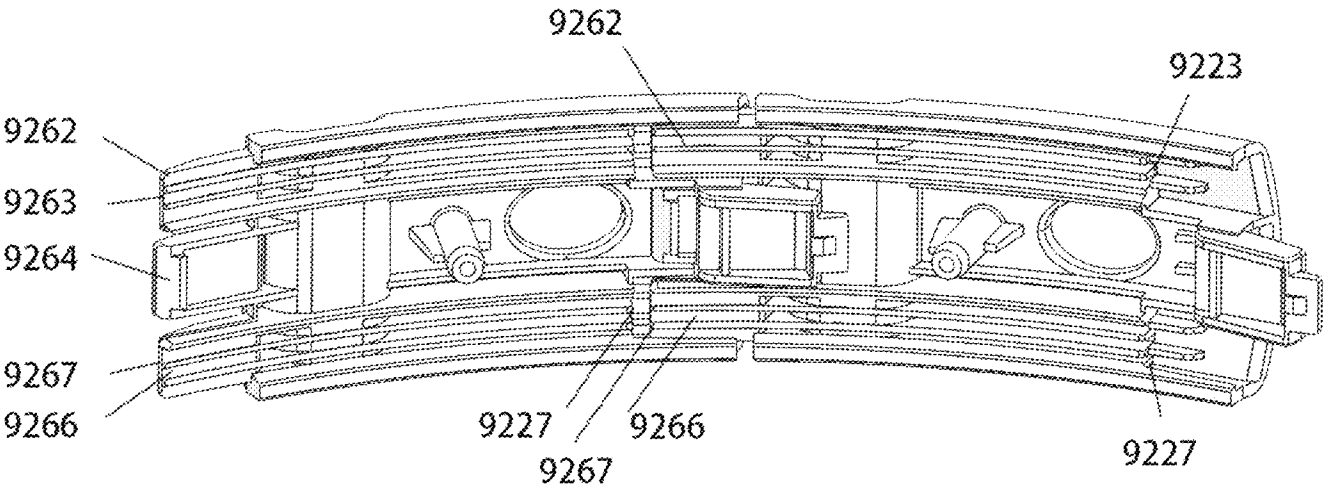
FIG. 9 illustrates two outer tracks during the assembly process.

FIG. 9 illustrates two outer tracks during the assembly process, with other components of the track units hidden. The protruding portion of the outer track may include side protruding fingers 9262, 9266, and an intermediate protruding finger 9264 located between them. As mentioned above, the intermediate protruding finger 9264 is used for the snap-fit connection between two adjacent outer tracks or track units. The side protruding fingers 9262, 9266 are inserted into the side channels 5222 and 5226 of the receiving channel 522, respectively. After assembly, a distance between an end face 9263 of the side protruding finger 9262 of the outer track and an end face 9223 for delimiting the side channel of the adjacent outer track is in the range of 0.5 mm to 10 mm, particularly in the range of 1 mm to 5 mm, and more particularly in the range of 1.5 mm to 3 mm, such as 2 mm. Similarly, after assembly, a distance between an end face 9267 of the side protruding finger 9266 of the outer track and an end face 9227 for delimiting the side channel of the adjacent outer track is in the range of 0.5 mm to 10 mm, particularly in the range of 1 mm to 5 mm, and more particularly in the range of 1.5 mm to 3 mm, such as 2 mm. This design ensures that when the rollers of the slider roll along a circular path defined by both the inner and outer tracks, they do not pass through a long section with notches (which could hinder the slider's movement and result in significant noise). This design significantly reduces the generation of noise, especially when combined with the use of rollers made from the aforementioned material, it can even achieve a silent operation.

The above merely describes specific embodiments of the present disclosure, which is not intended to limit the scope of protection of the present disclosure. Any modifications, equivalent variations or substitutions, and improvements made within the spirit and principle of the present disclosure by those skilled in the art according to the disclosed technical scope should be included in the protection scope of the present disclosure.

The invention claimed is:

1. A hula hoop, comprising:

a track assembly with a plurality of track units interconnected end-to-end, and a slider provided with one or more rollers configured to slide along a circular path, wherein each track unit of the plurality of track units includes an outer track having a receiving channel located at a first end and a protruding portion located at a second end opposite to the first end, wherein the protruding portion of the outer track includes side protruding fingers and an intermediate protruding finger located between the side protruding fingers, and the side protruding fingers of one track unit is configured to be inserted into respective side channels of the receiving channel of another track unit, such that after the track units are assembled, a distance between an end face of the side protruding finger of the outer track of the one track unit and an end face that delimits the side channel of another track unit within which the protruding finger is inserted is in the range of 0.5 mm to 10 mm, and wherein the slider is provided with a light emitting device.

2. The hula hoop according to claim 1, wherein the slider includes a first half part and a second half part defined by a dividing plane, each half part having a base portion and an extending portion, wherein the base portion is provided with one or more roller bars, and wherein the rollers are mounted on the roller bars and are rotatable.

3. The hula hoop according to claim 2, wherein each extending portion has a first opening, and the first openings of two extending portions jointly define a cavity for accommodating the light emitting device, and the light emitting device is arranged within the cavity.

4. The hula hoop according to claim 3, wherein the slider is provided with a controller and a sensor for detecting movement of the slider, and wherein the controller is configured to control the light emitting device based on the detection by the sensor.

5. The hula hoop according to claim 4, wherein when the slider's rotation speed is within a first speed range, the controller controls the light emitting device to emit lights of a first color, and when the slider's rotation speed is within a second speed range, the controller controls the light emitting device to emit lights of a second color different from the first color.

6. The hula hoop according to claim 4, wherein when the slider's rotation speed is within a first speed range, the controller controls the light emitting device to flash at a first frequency, and when the slider's rotation speed is within a second speed range, the controller controls the light emitting device to flash at a second frequency different from the first frequency.

7. The hula hoop according to claim 6, wherein the rotation speed of the slider within the first speed range is lower than that in the second speed range, and the second frequency is greater than the first frequency.

8. The hula hoop according to claim 4, wherein the controller controls the light emitting device to continuously illuminate.

9. The hula hoop according to claim 4, wherein when the slider's rotation speed is within a first speed range, the controller controls the light emitting device to illuminate at a first brightness, and when the slider's rotation speed is within a second speed range, the controller controls the light emitting device to illuminate at a second brightness different from the first brightness.

10. The hula hoop according to claim 9, wherein the rotation speed of the slider within the first speed range is lower than that in the second speed range, and the second brightness is greater than the first brightness.

11. The hula hoop according to claim 1, wherein each track unit comprises:

a pressing component configured to secure two adjacent track units, and an inner track, which defines a circular path together with the outer track.

12. The hula hoop according to claim 11, wherein the pressing component is switchable between a first position and a second position, wherein in the first position, an elastic element of the pressing component is forced to deform away from a pressing body of the pressing component, and wherein in the second position, the elastic element of the pressing component is not forced and remains stationary relative to the outer track and/or the inner track.

13. The hula hoop according to claim 12, wherein the inner track has a limiting column for restricting movement of the pressing body operated by a user.

14. The hula hoop according to claim 1, wherein the hula hoop is provided with an added weight, which is attached to the slider through a tether, and wherein the added weight includes a shell, and the shell is filled with at least one of water, sand, and metal particles.

15. The hula hoop according to claim 1, wherein a material for the roller is selected from at least one of nylon, polyoxymethylene, acrylonitrile butadiene styrene, and polyurethane.

16. The hula hoop according to claim 1, wherein each track unit comprises:

the outer track, an inner track connected to the outer track to jointly define a circular path, and a support fixed to the inner track.

17. The hula hoop according to claim 16, wherein the support is positioned close to an end of the inner track.

* * * * *